US007358675B2

(12) United States Patent
Yamashita et al.

(10) Patent No.: US 7,358,675 B2
(45) Date of Patent: Apr. 15, 2008

(54) LOW-PRESSURE DISCHARGE LAMP AND BACK LIGHT DEVICE USING SAME

(75) Inventors: Hirofumi Yamashita, Moriguchi (JP); Haruo Yamazaki, Moriyama (JP); Toshihiro Terada, Amagasaki (JP); Shinji Kihara, Maizuru (JP)

(73) Assignees: Matsushita Electric Industrial Co., Ltd., Osaka (JP); Panasonic Photo & Lighting Co., Ltd., Osaka (JP)

( * ) Notice: Subject to any disclaimer, the term of this patent is extended or adjusted under 35 U.S.C. 154(b) by 0 days.

(21) Appl. No.: 10/502,892

(22) PCT Filed: Jul. 17, 2003

(86) PCT No.: PCT/JP03/09119

§ 371 (c)(1),
(2), (4) Date: Jul. 27, 2004

(87) PCT Pub. No.: WO2004/017360

PCT Pub. Date: Feb. 26, 2004

(65) Prior Publication Data

US 2005/0077830 A1 Apr. 14, 2005

(30) Foreign Application Priority Data

Jul. 19, 2003 (JP) ..... 2002-211594

(51) Int. Cl.
*H01J 61/067* (2006.01)
*H01J 61/12* (2006.01)
*H01J 61/20* (2006.01)

(52) U.S. Cl. ..... 313/631; 313/633; 313/641; 313/491

(58) Field of Classification Search ..... 313/491, 313/631, 637, 639, 641, 633, 576
See application file for complete search history.

(56) References Cited

U.S. PATENT DOCUMENTS 5,962,977 A * 10/1999 Matsumoto et al. ..... 313/633

(Continued)

FOREIGN PATENT DOCUMENTS

JP 4-137429 5/1992

(Continued)

*Primary Examiner*—Karabi Guharay
(74) *Attorney, Agent, or Firm*—Hamre, Schumann, Mueller & Larson, P.C.

(57) ABSTRACT

A low-pressure discharge lamp (1) is provided that includes a glass tube (2) having an inner diameter in a range of 1 to 5 mm and a pair of electrodes (3) disposed at end portions in the glass tube (2). The pair of electrodes (3) contain at least one transition metal selected from transition metals of Groups IV to VI. Mercury and a rare gas containing argon and neon are sealed in an inner portion of the glass tube (2). A relationship between a cathode glow discharge density J and a composition index α of the sealed rare gas of the low-pressure discharge lamp (1) satisfies the following expression $$\alpha \leqq J = I/(S \cdot P^2) \leqq 1.5\alpha$$

(where S represents an effective discharge surface area ($mm^2$) of an electrode, I represents a RMS lamp current (mA), P represents a pressure (kPa) of a sealed rare gas, and α represents a composition index of a sealed rare gas that is a constant expressed by $\alpha=(90.5A+3.4N)\times10^{-3}$ when a total of a composition ratio A of argon and a composition ratio N of neon is expressed by A+N=1).

11 Claims, 4 Drawing Sheets

U.S. PATENT DOCUMENTS

| | | | | |
|---|---|---|---|---|
| 6,057,635 | A * | 5/2000 | Nishimura et al. | 313/25 |
| 6,166,491 | A * | 12/2000 | Tsuchiya et al. | 315/169.3 |
| 6,388,394 | B1 * | 5/2002 | Mita et al. | 315/291 |
| 6,800,997 | B2 | 10/2004 | Yamashita et al. | |
| 6,943,499 | B2 | 9/2005 | Yamashita et al. | |

FOREIGN PATENT DOCUMENTS

| | | | |
|---|---|---|---|
| JP | 6-5228 | | 2/1994 |
| JP | 275237 | | 9/1994 |
| JP | 8-190890 | | 7/1996 |
| JP | 10-21873 | | 1/1998 |
| JP | 10-199476 | | 7/1998 |
| JP | 10199476 | * | 7/1998 |
| JP | 11185699 A | * | 7/1999 |
| JP | 11-185699 | | 9/1999 |
| JP | 2001-76617 | | 3/2001 |
| JP | 2001-325915 | | 11/2001 |
| JP | 2002-184356 | | 6/2002 |
| JP | 2002-289137 | | 10/2002 |

* cited by examiner

LOW-PRESSURE DISCHARGE LAMP AND BACK LIGHT DEVICE USING SAME

TECHNICAL FIELD

The present invention relates to a low-pressure discharge lamp that is used in a back light for various types of liquid crystal displays and the like. Specifically, this invention relates to a cold cathode fluorescent lamp of a small tube diameter including a cylindrical electrode with a hollow structure that is suitable for long-life use, and a back light device using the same.

BACKGROUND ART

Conventionally, with the diversification of liquid crystal displays, various studies have been carried out on a low-pressure discharge lamp for a back light device in order to achieve a thin tube structure, a high luminance, a long life and the like. As one of the methods for achieving these, a method is known in which an electrode made from a material having a low work function such as nickel is formed in any of various shapes including the shapes of a bar, a cylinder, a bottomed cylinder, a cap and the like so as be decreased in size as much as possible. This method suppresses electrode consumption due to sputtering that takes place during lighting of a low-pressure discharge lamp.

For example, in the case of the cylindrical electrode described in JP 4(1992)-137429 A, cathode glow discharge comes into the inner portion of the cylindrical electrode. Therefore, this suppresses a phenomenon in which a waste of an electrode material scattered by sputtering reaches portions of the inner wall of a low-pressure discharge lamp to cause blackening. Moreover, an electrode substance that has been sputtered is turned back into the electrode in the cylindrical electrode and reused. Therefore, mercury consumption resulting from electrode substance consumption also is suppressed. Thus, from the aspect of the performance of a low-pressure discharge lamp, it is effective to adopt a small-sized cylindrical electrode or the like.

However, in the case where the low-pressure discharge lamp is required to attain a higher luminance and thus is used in a large current region, and in the case where it is required that the low-pressure discharge lamp be of a thin tube structure and a smaller electrode be used in order to meet a demand for a size reduction of a liquid crystal display frame, the following further should be addressed.

That is, in the case where a smaller electrode is used and a lamp current is increased, a cathode glow discharge density (value obtained by dividing a current density per a unit effective discharge surface area of the electrode by a square of a sealing pressure of a rare gas) and a cathode fall voltage are increased so that a shortage of an effective discharge surface area of the electrode is compensated. This results in a phenomenon in which a glow discharge transition from normal glow to abnormal glow is caused. By the abnormal glow, the consumption of a rare gas sealed in a low-pressure discharge lamp is accelerated as a result of a rapid increase in the sputtering amount of an electrode material, thereby causing a problem of a short lamp life.

Furthermore, the use of a thin tube structure and a large current density, and a reduction in space for a low-pressure discharge lamp unit cause an atmospheric temperature during lighting of a low-pressure discharge lamp to be increased excessively to a temperature not lower than a temperature at which an optimum level of an emitted luminous flux is maintained, thereby also causing a problem of a decrease in an emitted luminous flux.

DISCLOSURE OF THE INVENTION

The present invention provides a low-pressure discharge lamp including a glass tube having an inner diameter in a range of 1 to 5 mm and a pair of electrodes disposed at end portions in the glass tube. The pair of electrodes contain at least one transition metal selected from transition metals of Groups IV to VI. Mercury and a rare gas containing argon and neon are sealed in an inner portion of the glass tube. In the low-pressure discharge lamp, a relationship between a cathode glow discharge density (converted into a current density) J and a composition index $\alpha$ of the sealed rare gas of the low-pressure discharge lamp satisfies the following expression $$\alpha \leqq J = I/(S \cdot P^2) \leqq 1.5\alpha$$

(where J represents a value obtained by dividing a current density per a unit effective discharge surface area of an electrode by a square of a sealing pressure P of a rare gas, S represents an effective discharge surface area ($mm^2$) of an electrode, I represents a RMS lamp current (mA), P represents the pressure (kPa) of a sealed rare gas, and a represents a composition index of a sealed rare gas that is a constant expressed by $\alpha=(90.5A+3.4N)\times10^{-3}$ when a total of a composition ratio A of argon and a composition ratio N of neon is expressed by A+N=1).

Furthermore, the present invention provides a low-pressure discharge lamp including a glass tube having an inner diameter in a range of 1 to 5 mm and a pair of electrodes disposed at end portions in the glass tube. The pair of electrodes contain at least one transition metal selected from transition metals of Groups IV to VI. Mercury and a rare gas containing argon, neon and krypton are sealed in an inner portion of the glass tube. In the low-pressure discharge lamp, a relationship between a cathode glow discharge density (converted into a current density) J and a composition index $\alpha$ of the sealed rare gas of the low-pressure discharge lamp satisfies the following expression $$\alpha \leqq J = I/(S \cdot P^2) \leqq 1.5\alpha$$

(where J represents a value obtained by dividing a current density per a unit effective discharge surface area of an electrode by a square of a sealing pressure P of a rare gas, S represents an effective discharge surface area ($mm^2$) of an electrode, I represents a RMS lamp current (mA), P represents the pressure (kPa) of a sealed rare gas, and a represents a composition index of a sealed rare gas that is a constant expressed by $\alpha=(90.5A+3.4N+24.3K)\times10^{-3}$ when a total of a composition ratio A of argon, a composition ratio N of neon, and a composition ratio K of krypton is expressed by A+N+K=1).

BEST MODE FOR CARRYING OUT THE INVENTION

Figure 1:
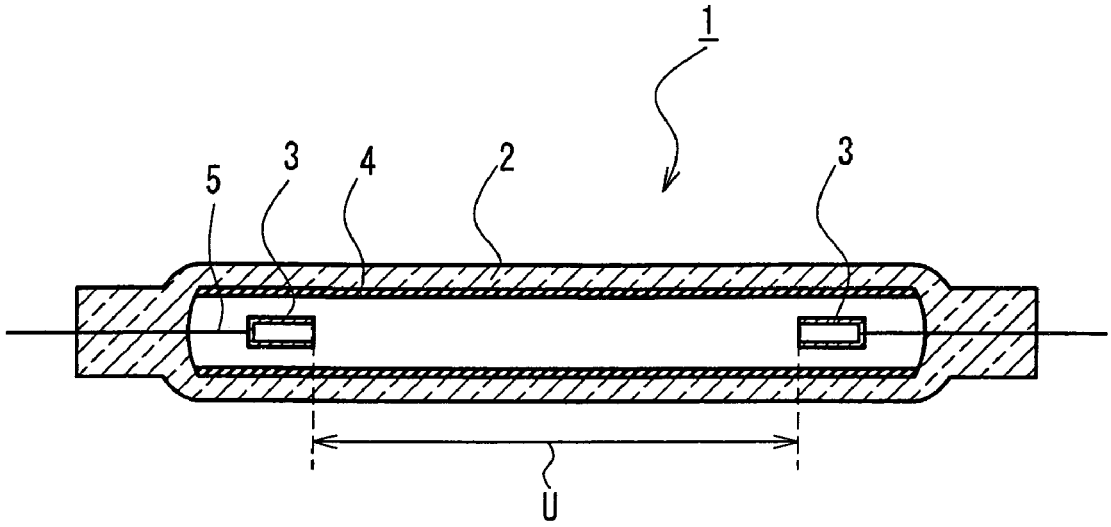
FIG. 1 is a cross-sectional view showing an example of a low-pressure discharge lamp according to the present invention.

The low-pressure discharge lamp according to the present invention suppresses sputtering of a small-sized electrode thereby to suppress the consumption of a rare gas sealed in the lamp so as to increase its life, and prevents a decrease of an emitted luminous flux. Hereinafter, the present invention will be described by way of an embodiment.

An example of the low-pressure discharge lamp according to the present invention includes a glass tube having an inner diameter in a range of 1 to 5 mm and a pair of electrodes disposed at end portions in the glass tube. The pair of electrodes contain at least one transition metal selected from transition metals of Groups IV to VI. Mercury and a rare gas containing argon and neon are sealed in an inner portion of the glass tube. In the low-pressure discharge lamp, a relationship between a cathode glow discharge density (converted into a current density) J and a composition index α of the sealed rare gas of the low-pressure discharge lamp satisfies the following expression $$\alpha \leqq J = I/(S \cdot P^2) \leqq 1.5\alpha$$

(where J represents a value obtained by dividing a current density per a unit effective discharge surface area of an electrode by a square of a sealing pressure P of a rare gas, S represents an effective discharge surface area ($mm^2$) of an electrode, I represents a RMS lamp current (mA), P represents the pressure (kPa) of a sealed rare gas, and a represents a composition index of a sealed rare gas that is a constant expressed by $\alpha=(90.5A+3.4N)\times10^{-3}$ when a total of a composition ratio A of argon and a composition ratio N of neon is expressed by A+N=1).

Furthermore, another example of the low-pressure discharge lamp according to the present invention includes a glass tube having an inner diameter in a range of 1 to 5 mm and a pair of electrodes disposed at end portions in the glass tube. The pair of electrodes contain at least one transition metal selected from transition metals of Groups IV to VI. Mercury and a rare gas containing argon, neon and krypton are sealed in an inner portion of the glass tube. In the low-pressure discharge lamp, a relationship between a cathode glow discharge density (converted into a current density) J and a composition index α of the sealed rare gas of the low-pressure discharge lamp satisfies the following expression $$\alpha \leqq J = I/(S \cdot P^2) \leqq 1.5\alpha$$

(where J represents a value obtained by dividing a current density per a unit effective discharge surface area of an electrode by a square of a sealing pressure P of a rare gas, S represents an effective discharge surface area ($mm^2$) of an electrode, I represents a RMS lamp current (mA), P represents the pressure (kPa) of a sealed rare gas, and a represents a composition index of a sealed gas that is a constant expressed by $\alpha=(90.5A+3.4N+24.3K)\times10^{-3}$ when a total of a composition ratio A of argon, a composition ratio N of neon, and a composition ratio K of krypton is expressed by A+N+K=1).

According to the above-mentioned configurations, the relationship between the composition index α of a sealed rare gas and the cathode glow discharge density can be optimized. Further, since the electrode material is limited to transition metals of Groups IV to VI, a rate of sputtering due to iron impact is small and a work function is low. Therefore, even when a large electric current is used, a transition from normal glow discharge to abnormal glow discharge that is caused by a shortage of a discharge area of the electrode can be suppressed. Thus, an increase in the sputtering amount of the electrode can be suppressed, thereby allowing the cause of a short life of the low-pressure discharge lamp to be eliminated.

The coefficients in the above-mentioned expression for the composition index α of a sealed rare gas, i.e. 90.5, 3.4, 24.3, are values corresponding to the respective partial pressures of argon, neon, and krypton in the glass tube.

Furthermore, preferably, in the low-pressure discharge lamp according to this embodiment, the pair of electrodes contain as a main component at least one metal selected from niobium and tantalum.

As an electrode material, a non-sinterable metal having a high melting point such as niobium, tantalum or the like is used, and thus primary working such as performed to manufacture a metal plate and metal foil and secondary working such as performed to process these products into a cylindrical shape or the like also are facilitated. Further, among transition metals of Groups IV to VI, metals such as niobium, tantalum and the like are electrode materials having stable physical properties that hardly are affected by an impure gas and heat generated during manufacturing of the lamp, and their work function is low. Thus, a stable life property of the low-pressure discharge lamp that is not affected by a manufacturing process of the lamp can be obtained. Herein, a main component refers to a component that is contained in an amount of not less than 90 wt % with respect to the whole weight.

Furthermore, preferably, in the low-pressure discharge lamp according to this embodiment, the pair of electrodes are formed in a cylindrical shape, and a relationship between an outer diameter d (mm) of each of the pair of electrodes and an inner diameter D (mm) of the glass tube satisfies an expression $d \geqq D-0.4$ (mm).

Forming the electrode in a cylindrical shape allows the outer surface and the inner surface of the cylindrical electrode to be used. Thus, compared with a bar-like electrode whose outer surface only can be used, an effective discharge surface area S of the electrode that can be used for discharge can be increased, thereby providing a longer life time for the low-pressure discharge lamp. Further, the relationship of the gap between the cylindrical electrode and the inner face of the glass tube is set so that the outer diameter d (mm) of the cylindrical electrode with respect to the inner diameter D (mm) of the glass tube is expressed by $d \geqq D-0.4$ (mm). This configuration allows glow discharge to be carried out only on the inner surface of the cylindrical electrode without being led onto the outer surface of the cylindrical electrode, and thus a hollow effect of the cylindrical electrode can be attained, thereby achieving a longer life time of the low-pressure discharge lamp.

The above-mentioned effective discharge surface area S of an electrode refers to a surface area of the electrode at a portion in which discharge actually is occurring. For example, in the case of a cylindrical electrode, the effective discharge surface area S refers to (i) only an area of the inner surface of the cylindrical electrode, or (ii) both of the respective areas of the inner surface and the outer surface of the cylindrical electrode. That is, with a larger difference between the inner diameter of a glass tube and the outer diameter of the cylindrical electrode, discharge occurs on both of the inner surface and the outer surface of the cylindrical electrode.

Furthermore, preferably, in the low-pressure discharge lamp according to this embodiment, a current density I/S per the unit effective discharge surface area during undimmed lighting of the low-pressure discharge lamp is not higher than 1.5 ($mA/mm^2$).

According to this configuration, an action is exerted in which a lamp surface temperature in an electrode portion can be suppressed to a temperature not higher than 100° C., at which the operation of liquid crystal is affected. Thus, the low-pressure discharge lamp can be used in a stable current density region.

Furthermore, preferably, in the low-pressure discharge lamp according to this embodiment, in dimmed lighting, the low-pressure discharge lamp is used by pulse width modulation driving (PWM driving) by way of high-frequency lighting, and the RMS lamp current I is a value obtained at a current peak.

According to this configuration, even in high-frequency lighting by way of PWM driving in which a peak current becomes large, which is intended to achieve a high image quality of a liquid crystal screen, the electrode can withstand sputtering. Thus, a stable life property of the low-pressure discharge lamp can be obtained.

Furthermore, preferably, in the low-pressure discharge lamp according to this embodiment, the glass tube has a thickness t in a range of $0.15\ mm \leqq t \leqq 0.20\ mm$.

The thickness of the glass tube is set so as to be in the above-mentioned range, and thus compared with the conventional case, the outer surface area of the glass tube is reduced. Therefore, in the low-pressure discharge lamp, even when discharge is carried out using a large electric current, heat dissipation from the lamp is suppressed, and a decrease in mercury vapor pressure can be prevented, thereby also achieving higher life performance of the lamp.

Furthermore, an example of a back light device according to the present invention is equipped with the above-mentioned low-pressure discharge lamp.

According to this configuration, a back light device for liquid crystal equipment that is suitable for the use of a large electric current and a thickness reduction can be obtained, and an effect of increasing a life can be enhanced.

Furthermore, the low-pressure discharge lamp described in the above-mentioned embodiment is mounted in an apparatus such as a liquid crystal display or the like that is decreased in thickness and size. This allows the realization of a back light device that is decreased in size and has a large current density and thus achieves a high luminance and a long life time.

Moreover, according to the above-mentioned configuration, even in high-frequency lighting by way of PWM driving that is an operation using a large electric current, which is intended to achieve a high image quality of a liquid crystal screen, the electrode can withstand sputtering. Thus, a stable life time property of the low-pressure discharge lamp can be obtained.

Next, the embodiment of the present invention will be described with reference to appended drawings.

FIG. 1 is a cross-sectional view showing an example of the low-pressure discharge lamp according to the present invention. In FIG. 1, a low-pressure discharge lamp 1, which is a cold cathode fluorescent lamp, is formed from Kovar glass, soda-lime glass, borosilicate glass, and other materials. The low-pressure discharge lamp 1 has a tube inner diameter in a range of 1 to 5 mm and is configured as follows. That is, predetermined materials such as mercury and a rare gas containing argon, neon and the like are sealed in a glass tube 2 having an arbitrary length. Further, a pair of electrodes 3, which are for a cold cathode, are provided at tube ends, and a phosphor 4 is applied to the inner side face of the glass tube 2. Each of the electrodes 3 is connected to the exterior of the glass tube 2 through an interior lead-in wire 5.

The electrode 3 is formed from a transition metal of Groups IV to VI such as niobium, tantalum or the like, and may have the shape of a bottomed cylinder, an unbottomed cylinder, a cap, a bar or the like.

The phosphor 4 may be applied to the entire inner side face of the glass tube 2 as shown in FIG. 1. However, it only is required that the phosphor 4 be applied at least to a portion of the inner side face of the glass tube 2 that corresponds to a distance U between the pair of electrodes 3.

The above-mentioned low-pressure discharge lamp is configured so that as described above, the relationship between a cathode glow discharge density (converted into a current density) J and a composition index $\alpha$ of a sealed rare gas satisfies $\alpha \leqq J = I/(S \cdot P^2) \leqq 1.5\alpha$.

Figure 2:
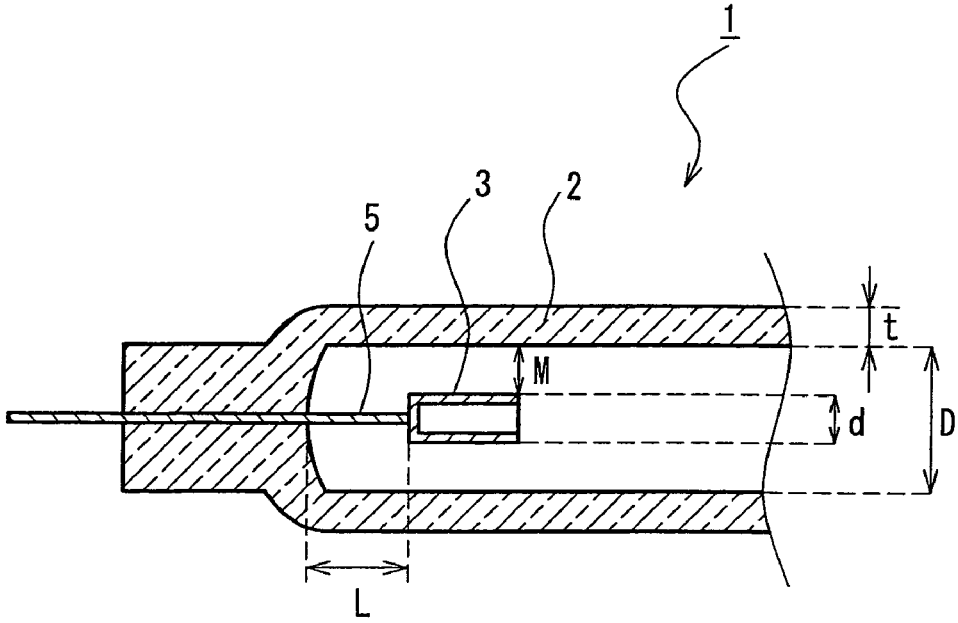
FIG. 2 is an expanded cross-sectional view showing a main portion of FIG. 1.

FIG. 2 is an expanded cross-sectional view showing a main portion of the low-pressure discharge lamp shown in FIG. 1. In the low-pressure discharge lamp according to this embodiment, the relationship between an outer diameter d (mm) of the electrode 3 and an inner diameter D (mm) of the glass tube 2 is set so as to satisfy $d \geqq D-0.4$ (mm) and thus a difference between them is small. Therefore, in the case of using the electrode 3 having a cylindrical shape, glow discharge is carried out only on the inner surface of the cylindrical electrode 3 without being led into a minute gap on the outer side of the electrode. Thus, a lower cathode fall voltage is attained, thereby allowing a long life of the low-pressure discharge lamp to be provided by a hollow effect.

Figure 3:
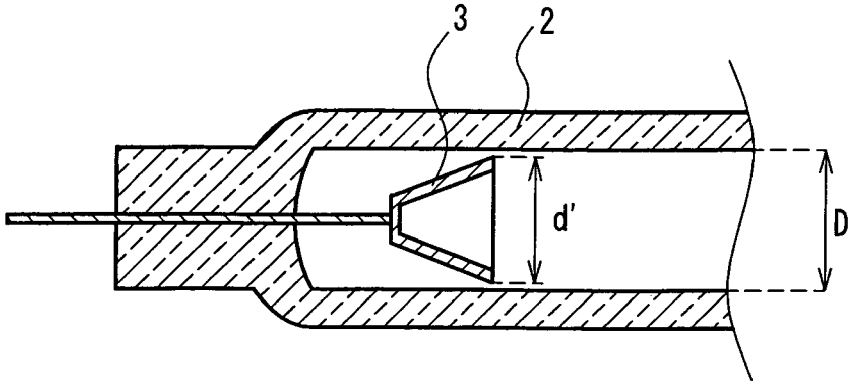
FIG. 3 is a cross-sectional view showing another example of an electrode used in the present invention.
Figure 4:
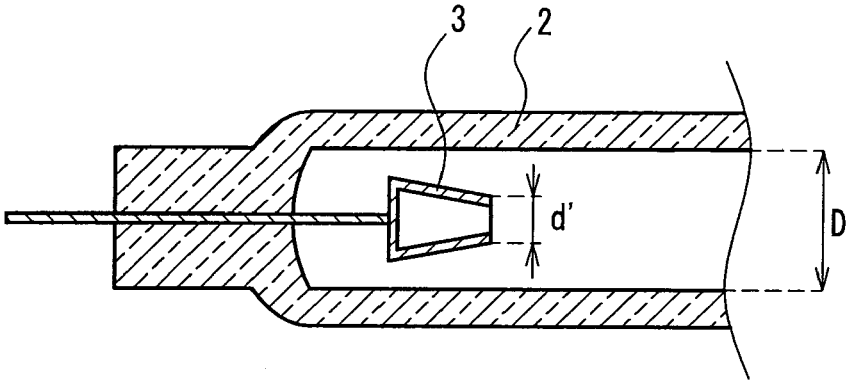
FIG. 4 is a cross-sectional view showing still another example of the electrode used in the present invention.
Figure 5:
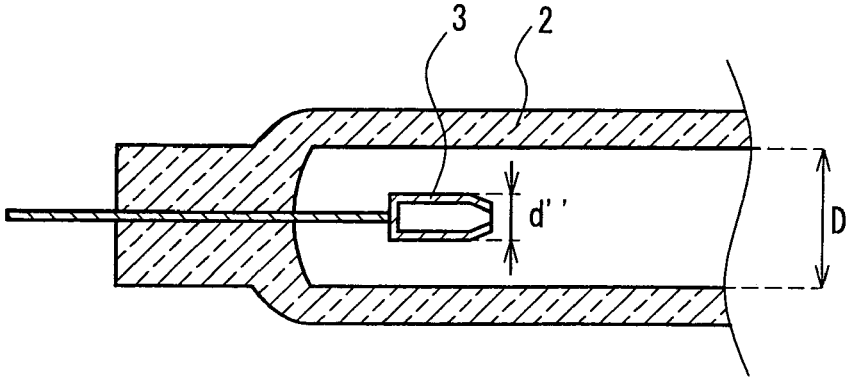
FIG. 5 is a cross-sectional view showing still another example of the electrode used in the present invention.

Furthermore, in the case of using the electrode 3 having the shape showing in FIG. 3 or FIG. 4, it is preferable as in the above-mentioned case that the relationship between an outer diameter d' (mm) of the electrode 3 at an end portion of its opening and an inner diameter D (mm) of the glass tube 2 satisfies an expression $d' \geqq D-0.4$ (mm). Further, in the case of using the electrode 3 having the shape shown in FIG. 5, it is preferable as in the above-mentioned case that the relationship between an outer diameter d" (mm) of the electrode 3 at a portion most proximate to the glass tube 2 in the vicinity of its front end portion and an inner diameter D (mm) of the glass tube 2 satisfies an expression $d'' \geqq D-0.4$ (mm).

Moreover, in the case where the electrode 3 is formed in the cylindrical shape, if a maximum gap M between the electrode 3 at an end portion of its opening and the glass tube 2 is not more than 0.2 mm, even when the electrode 3 tilts slightly toward the glass tube 2, glow discharge is not led into a minute gap on the outer side of the electrode.

Furthermore, preferably, in the low-pressure discharge lamp according to this embodiment, the electrode 3 is formed in a shape of a bottomed cylinder, and a distance L between a bottom portion of the electrode 3 and a surface of the glass tube 2 opposed to the bottom portion is not more than 0.2 mm. Generally, the bottom portion of the bottomed cylindrical electrode 3 is formed so as to be joined using the interior lead-in wire 5 formed of a material whose strength is low compared with other portions. With the distance L having a value in this range, glow discharge is not led into a joint portion of the electrode, thereby allowing a longer life of the low-pressure discharge lamp to be achieved. However, in this case, with the distance L=0, a crack is caused in the glass tube 2 when the interior lead-in wire 5 is attached hermetically to the glass tube 2. Therefore, it is necessary that the distance L have a value of at least 0.05 mm that corresponds to the coating thickness of the phosphor.

Furthermore, in the low-pressure discharge lamp according to this embodiment, the glass tube has a thickness t in a range of 0.15 mm≦t≦0.20 mm. Therefore, in the low-pressure discharge lamp, even when discharge is carried out using a large electric current, heat dissipation from the lamp is suppressed, and higher life performance of the lamp also is achieved.

Next, an example of the low-pressure discharge lamp according to the present invention will be described in detail by way of examples.

EXAMPLE 1

First, a low-pressure discharge lamp shown in FIG. 1 was manufactured in the following manner. That is, a three-wavelength-region emitting phosphor having a color temperature of 5,000 K was applied to the inner face of a glass tube in a thickness of about 20 μm. The glass tube was formed from borosilicate glass and had an outer diameter of 1.8 mm, an inner diameter of 1.4 mm, and a length of about 300 mm.

Next, a bottomed cylindrical electrode shown in FIG. 2 was formed. The cylindrical electrode was formed from niobium and had an outer diameter of 1.1 mm, an inner diameter of 0.9 mm, and a length of 1.5 mm. As an interior lead-in wire, a tungsten wire having an outer diameter of 0.6 mm was used. The interior lead-in wire was connected to the cylindrical electrode by resistance welding. In the glass tube, 1,500 μg of mercury and a neon-argon mixed gas of 95 vol % neon and 5 vol % argon were sealed at different sealing pressures, and thus sample lamps that vary in the sealing pressure were obtained.

The above-mentioned sample lamps were grouped into Sample lamp group (a). For comparison, in the same manner as in the above-mentioned case, sample lamps for Sample lamp group (b) were manufactured on the same conditions as in the case of Sample lamp group (a) except that nickel was used as an electrode material. With respect to each of the sample lamps of the low-pressure discharge lamp in Sample lamp groups (a) and (b) described above, a lighting test was performed in the following manner. That is, dimmed lighting was performed by pulse width modulation driving (PWM driving) by way of high-frequency lighting at 60 kHz. In the lighting, a current density I/S of the electrode was set so as to vary.

In the above-mentioned lighting test, the degree at which the rare gas in each of the sample lamps of the low-pressure discharge lamp was consumed after 1,000 hour lighting was determined by measurement. Then, as shown in FIG. 6, with respect to each of the sample lamps of the low-pressure discharge lamp in which the sealing pressure of the rare gas was decreased compared with that obtained at a lapse of zero hours before the test was started, a current density (I/S) of the electrode and a sealing pressure (P) of the rare gas were plotted on the vertical axis and the horizontal axis, respectively, and thus rare gas consumption boundary curves shown in FIG. 6 were obtained.

Figure 6:
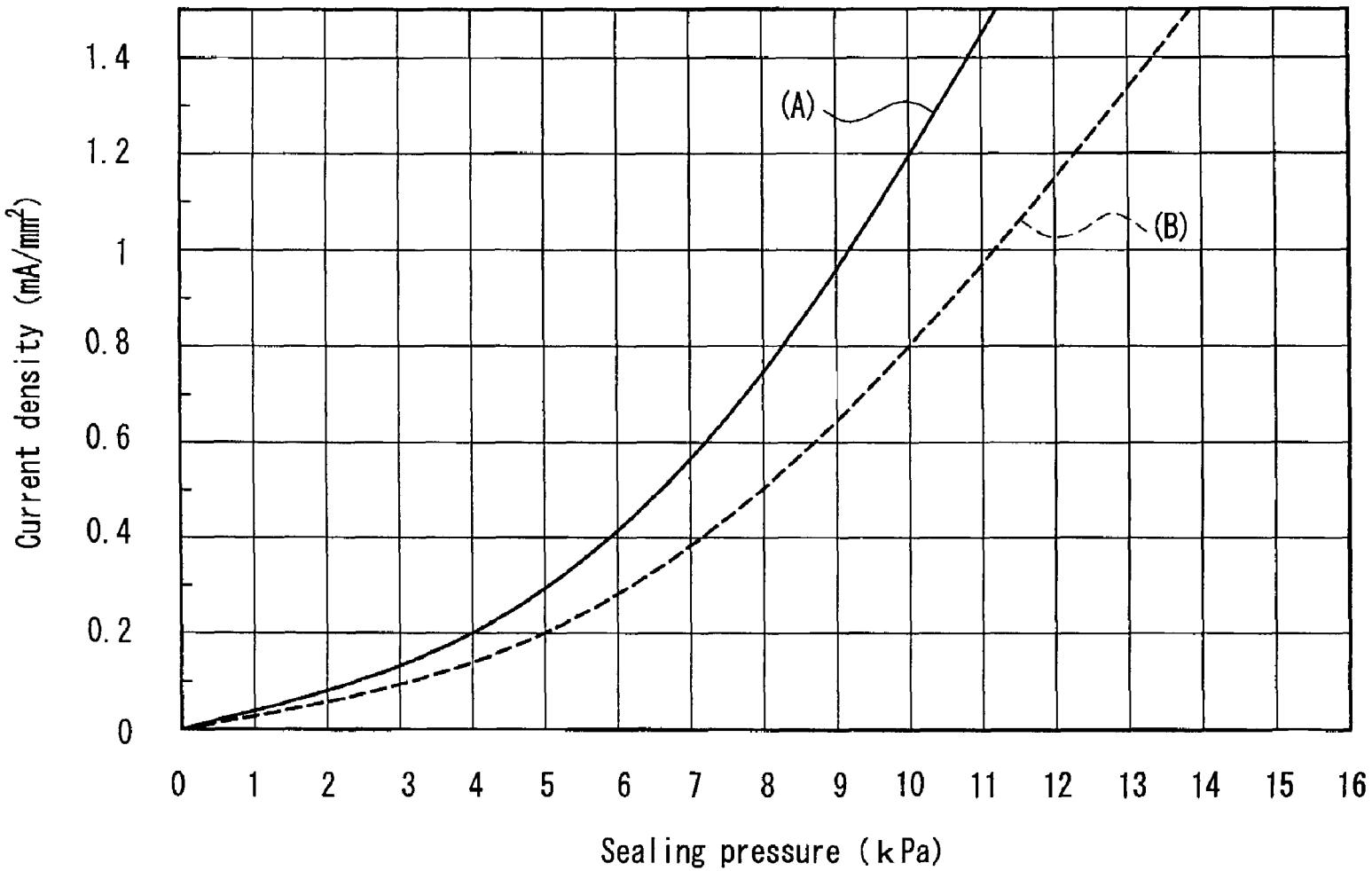
FIG. 6 is a diagram showing a rare gas consumption boundary curve representing the relationship between a current density of an electrode and a sealing pressure of a rare gas.

As a result, as shown in FIG. 6, a curve (A) is formed by Sample lamp group (a), and a boundary curve (B) is formed by Sample lamp group (b). With respect to each of the curves (A) and (B), a region on the left defines an abnormal glow discharge region, and a region on the right defines a normal glow discharge region. According to FIG. 6, compared with the boundary curve (B) (threshold value) between the abnormal glow discharge region and the normal glow discharge region of Sample lamp group (b) using the nickel electrode, the boundary curve (A) of Sample lamp group (a) using the niobium electrode is shifted toward larger current densities where the sealing pressures are the same. This confirms that even in the case of using an electrode whose size is small compared with a nickel electrode and a lamp of a small tube diameter, a transition from normal glow discharge to abnormal glow discharge is suppressed, thereby allowing a lamp life to be maintained for a long time.

Thus, in a low-pressure discharge lamp, in order to achieve a smaller tube diameter and smaller electrode size compared with a nickel electrode, it is necessary to secure a normal glow discharge region in an area defined by the boundary curve (A) and the boundary curve (B) that determine a boundary between normal glow discharge and abnormal glow discharge.

EXAMPLE 2

Next, with respect only to Sample lamp group (a) described above, the respective composition ratios of argon and neon in the sealed gas were set so as to vary. In this manner, sample lamps that vary in the composition ratios of argon and neon were manufactured and grouped into Sample lamp group (c). With respect to each of the sample lamps, a lighting test was performed so as to determine a cathode glow discharge density (J). The result showed that by satisfying the above-mentioned expression, which is shown below, the following were achieved. That is, rare gas consumption attributable to increased sputtering of an electrode was not caused, normal glow discharge could be maintained, and degradation of a luminous flux hardly occurred. Thus, a long life (50,000 hours) could be secured, and excellent starting characteristics also could be attained up to the end of the life time.

Expression: $\alpha \leqq J = I/(S \cdot P^2) \leqq 1.5\alpha$ $[\alpha = (90.5A + 3.4N) \times 10^{-3}]$ In the above-mentioned expression, 1.5α that represents an upper limit value corresponds to the boundary curve (A) shown in FIG. 6, and α that represents a lower limit value corresponds to the boundary curve (B) shown in FIG. 6.

The above-mentioned test confirmed the following. That is, in the case where the cathode glow discharge density (J) has a value lower than α in the above-mentioned expression, a life property can be attained even in a nickel electrode. In this case, the present invention is advantageous only in that it allows a slight size reduction of an electrode, and thus is not particularly beneficial from a practical viewpoint.

Furthermore, in the case where the cathode glow discharge density J had a value higher than 1.5α, during lighting of the low-pressure discharge lamp, the sealed gas was contained in a sputtered substance of the electrode, resulting in a phenomenon in which the pressure of the gas sealed in the low-pressure discharge lamp was decreased. In this case, it was confirmed that a decrease in the pressure of the sealed gas enhanced sputtering further, thereby hindering securing a desired life.

EXAMPLE 3

Figure 7:
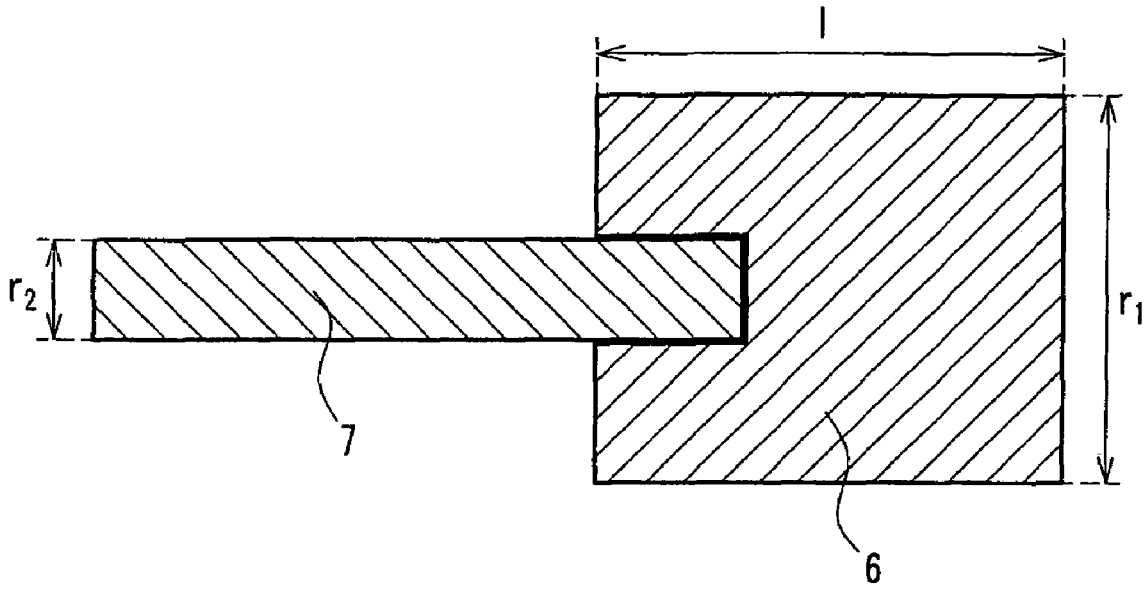
FIG. 7 is a cross-sectional view showing another example of the electrode according to the present invention.

Next, a cap-like electrode 6 shown in FIG. 7, which had a shape different from that shown in FIG. 2 as the shape used in the case of Sample lamp group (a) described above, was fitted on an electrode bar 7. Using the cap-like electrode 6 and the electrode bar 7, sample lamps for Sample lamp group (d) were manufactured in accordance with various conditions. With respect to each of the sample lamps, a cathode glow discharge density (J) was determined. In this case, Sample lamp group (d) had the same configuration as that of Sample lamp group (c) except for the shape of the electrode. The cap-like electrode 6 had an outer diameter $r_1$ of 0.9 mm and a length l of 2.5 mm. The electrode bar 7 had a diameter $r_2$ of 0.6 mm.

As a result of the above-mentioned determination, with regard to the cathode glow discharge density (J) obtained in the case of Sample lamp group (d), as in the test results obtained in the case of Sample lamp group (c), in each of the sample lamps of a low-pressure discharge lamp that satisfied the expression: $\alpha \leqq J = I/(S \cdot P^2) \leqq 1.5\ \alpha$, the following was achieved. That is, rare gas consumption attributable to increased sputtering of the electrode was not caused, normal glow discharge was maintained, and degradation of a luminous flux hardly occurred. Thus, a long life (40,000 hours) could be secured. Further, excellent starting characteristics also could be attained up to the end of the life time. In contrast, in each of the sample lamps of the low-pressure discharge lamp that did not satisfy the above-mentioned expression, rare gas consumption attributable to sputtering of the electrode caused a life time to be shortened, and a high degree of degradation of a luminous flux, a faulty starting operation and the like were caused, which was problematic from a practical viewpoint.

Based on the results of the above-mentioned tests, using tantalum and molybdenum as electrode materials other than niobium, sample lamps of a low-pressure discharge lamp having the same configuration as that of Sample lamp group (c) were manufactured as sample lamps for Sample lamp group (e) that used a tantalum electrode and sample lamps for Sample lamp group (f) that used a molybdenum electrode. Subsequently, a cathode glow discharge density (J) was determined. As a result, as in the case of Sample lamp group (c), in each of the sample lamps in Sample lamp groups (e) and (f) that satisfied the expression: $\alpha \leqq J = I/(S \cdot P^2) \leqq 1.5\ \alpha$, fast consumption of a sealed gas attributable to electrode sputtering was not caused, and a long life time (50,000 hours) could be maintained. Further, starting characteristics were maintained, and degradation of a luminous flux hardly occurred. In contrast, in each of the sample lamps of the low-pressure discharge lamp that did not satisfy the above-mentioned expression, a life time was shorted due to increased electrode sputtering, degradation of a luminous flux was accelerated, and a starting operation was hindered, which was problematic from a practical viewpoint.

EXAMPLE 4

Next, with regard to the outer diameter of an electrode, in order to determine the relationship between an outer diameter d of the bottomed cylindrical electrode shown in FIG. 2 and an inner diameter D of a glass tube, sample lamps for Sample lamp group (g) were manufactured so as to vary only in the outer diameter d of the electrode on the same conditions as those in the case of Sample lamp group (a), and properties thereof were determined.

The results showed the following. That is, with regard to the relationship between the outer diameter d of the electrode and the inner diameter D of the glass tube, each of the sample lamps that satisfied $d \geqq D-0.4$ (mm) was formed so that the gap between the cylindrical electrode and the inner wall of the tube was reduced to a degree that discharge was hindered from being transferred onto the outer side of the cylindrical electrode. Accordingly, in each of the above-mentioned sample lamps, during lighting, discharge progressed mainly on the inner face of the cylindrical electrode, and glow discharge was carried out only on the inner surface of the cylindrical electrode. Therefore, by the hollow effect of the cylindrical electrode, a cathode fall voltage could be decreased, and the effect of allowing a sputtered material to be reused could be attained, and thus a long life time (70,000 hours or longer) of a low-pressure discharge lamp and starting characteristics could be maintained, and degradation of a luminous flux also was reduced.

In contrast, in the case where $d<D-0.4$ (mm), it was confirmed that since part of glow discharge was carried out also on the outer face of the cylindrical electrode, the effect of allowing a sputtered material to be reused could not be attained fully, and thus the product was not suitable for the use in a long life time of longer than 50,000 hours.

EXAMPLE 5

Next, sample lamps for Sample lamp group (h-1) and Sample lamp group (h-2) were manufactured on the same conditions as in the case of Sample lamp group (a) except for the size of an electrode, and properties thereof were determined. As the sample lamp for Sample lamp group (h-1), a low-pressure discharge lamp that included a glass tube having an inner diameter of 5 mm, an outer diameter of 6 mm, and a length of 500 mm was used. As the sample lamp for Sample lamp group (h-2), a low-pressure discharge lamp that included a glass tube having an inner diameter of 6 mm, an outer diameter of 7 mm, and a length of 500 mm was used.

By using an electrode in the shape of a bottomed cylinder shown in FIG. 2 that had an inner diameter of 2.5 mm, an outer diameter of 3 mm, and a length of 3 mm, the properties of the sample lamps in both sample lamp groups were determined. As a result, both sample lamp groups exhibited life time properties that are satisfactory from a practical viewpoint.

However, compared with Sample lamp group (h-1), in each of the sample lamps in Sample lamp group (h-2), since the glass tube of a larger inner diameter was used, the surface temperature of the low-pressure discharge lamp was lower by about 5° C. With the decrease in the surface temperature, the mercury vapor pressure in the low-pressure discharge lamp became lower than an optimum value. Therefore, compared with Sample lamp group (h-1), in each of the sample lamps in Sample lamp group (h-2), the total amount of a luminous flux obtained during lighting of the low-pressure discharge lamp was lower by 10%, and thus the amount of a luminous flux required for a liquid crystal screen was not attained. This revealed that an initial luminous flux property could not be attained by a glass tube having an inner diameter larger than 5 mm.

Based on the results of the various tests described above, in relation to the prevention of abnormal glow discharge in a thin-tube low-pressure discharge lamp having a small-sized electrode, sample lamps for Sample lamp group (i) that vary in the composition of a sealed rare gas were manufactured. It was confirmed that a low-pressure discharge lamp in which argon in an amount in a range of 3 to 10 vol % was contained in neon could achieve a long life time sufficiently in sine wave lighting at about 40 to 100 kHz.

That is, in a thin-tube lamp in which too much argon is contained in a sealed gas, the temperature rise of electrons is reduced. In this case, the content of neon is increased so that the temperature of the electrons in the lamp increases, thereby allowing an emitted luminous flux to be increased. Furthermore, in the case where no argon is contained, red light originating mainly in neon is emitted immediately after lighting of a low-pressure discharge lamp is started. In this case, particularly under a low temperature, discharge of the above-mentioned red light continues for several minutes, which is disadvantageous from a practical viewpoint.

EXAMPLE 6

Next, the low-pressure discharge lamp that was found to be satisfactory from a practical viewpoint based on the tests performed using the above-mentioned sample lamps of various types in Sample lamp groups (a) to (i) was mounted in a back light device having a liquid crystal back light display system of an ultra-thin type. As a result, even in the case of using a small-sized electrode, a high luminance and a long life time could be achieved, thereby contributing to the realization of a size and thickness reduction, a high luminance, and a long life time of the back light device.

EXAMPLE 7

Low-pressure discharge lamps were manufactured in the same manner as in the cases of Examples 1 to 6 except that 1,500 μg of mercury and a neon-argon-krypton mixed gas of 95 vol % neon, 3 vol % argon, and 2 vol % krypton were sealed in a glass tube. As a result, the same results as in Examples 1 to 6 were obtained except that the above-mentioned relationship $\alpha=(90.5A+3.4N+24.3K)\times10^{-3}$ was established.

The configuration of the above-mentioned low-pressure discharge lamp according to the present invention is not limited to the materials, sizes, shapes and the like described under BEST MODE FOR CARRYING OUT THE INVENTION and in Examples, and other forms can be selected arbitrarily. For example, in the case where as a material of a glass tube, materials such as various types of glass including Kovar glass other than the materials described with regard to Examples are used, the effects also can be attained sufficiently. Further, the shape of an electrode also can be selected arbitrarily.

INDUSTRIAL APPLICABILITY

As described in the foregoing discussion, according to the present invention, in a compact low-pressure discharge lamp, fast consumption of a sealed gas when the low-pressure discharge lamp is used in a wide current region including a large current region is suppressed. Thus, even in the case of using a small-sized electrode, a high luminance and a long life time can be achieved, thereby allowing contribution to the realization of a size and thickness reduction, a high luminance, and a long life time of a back light device, which is highly valuable in the industrial field.

The invention claimed is:

1. A low-pressure discharge lamp, comprising:

a glass tube having an inner diameter in a range of 1 to 5 mm; and a pair of electrodes disposed at end portions in the glass tube, wherein the pair of electrodes are formed of a material without metal oxides, including at least one transition metal selected from transition metals of Groups IV to VI, mercury and a rare gas containing argon and neon are sealed in an inner portion of the glass tube, and a relationship $\alpha \leqq J \leqq 1.5\alpha$ is satisfied, where J represents a numerical value obtained from the expression $J=I/(S\cdot P^2)$, in which S represents a numerical value of an effective electrode discharge surface area ($mm^2$), I represents a numerical value of a RMS lamp current (mA), P represents a numerical value of the pressure (kPa) of a sealed rare gas, and α represents a numerical value obtained from the expression $\alpha=(90.5\ Ar+3.4N)\times10^{-3}$ where Ar and N represent relative composition ratios of argon and neon in the rare gas and Ar and N satisfy Ar+N=1.

2. The low-pressure discharge lamp according to claim 1, wherein the pair of electrodes contain as a main component at least one metal selected from niobium and tantalum.

3. The low-pressure discharge lamp according to claim 1, wherein the pair of electrodes are formed in a cylindrical shape, and a relationship between an outer diameter d (mm) of each of the pair of electrodes and an inner diameter D (mm) of the glass tube satisfies an expression $d \geqq D-0.4$ (mm).

4. The low-pressure discharge lamp according to claim 1, wherein the pair of electrodes are formed in a cylindrical shape, and a relationship between an outer diameter d (mm) of each of the pair of electrodes at an end portion of its opening and an inner diameter D (mm) of the glass tube satisfies an expression $d \geqq D-0.4$ (mm).

5. The low-pressure discharge lamp according to claim 1, wherein the pair of electrodes are formed in a cylindrical shape, and a maximum gap M between each of the pair of electrodes at an end portion of its opening and the glass tube is not more than 0.2 mm.

6. The low-pressure discharge lamp according to claim 1, wherein the pair of electrodes are formed in a shape of a bottomed cylinder, and a distance L between a bottom portion of each of the pair of electrodes and a surface of the glass tube opposed to the bottom portion is not more than 0.2 mm.

7. The low-pressure discharge lamp according to claim 1, wherein a current density (I/S) per unit effective discharge surface area during undimmed lighting of the low-pressure discharge lamp is not higher than 1.5 ($mA/mm^2$).

8. The low-pressure discharge lamp according to claim 1, wherein in dimmed lighting, the low-pressure discharge lamp is used by pulse width modulation driving (PWM driving) by way of high-frequency lighting, and the RMS lamp current I is a value obtained at a current peak.

9. The low-pressure discharge lamp according to claim 1, wherein the glass tube has a thickness t in a range of 0.15 mm≦t≦0.20 mm.

10. A back light device that is equipped with a low-pressure discharge lamp as claimed in claim 1.

11. The low-pressure discharge lamp according to claim 1, wherein the pair of electrodes consist essentially of the at least one transition metal selected from transition metals of Groups IV to VI.

* * * * *